US005313725A

United States Patent [19]

DeVassie

[11] Patent Number: 5,313,725

[45] Date of Patent: May 24, 1994

[54] CHANGEABLE DISPLAY NEWSPAPER VENDING MACHINE

[76] Inventor: Terry L. DeVassie, 5808 La Paz Pl., Westerville, Ohio 43081

[21] Appl. No.: 886,854

[22] Filed: May 22, 1992

[51] Int. Cl.[5] ..... G09F 7/00

[52] U.S. Cl. ..... 40/312; 40/661; 40/642

[58] Field of Search ..... 40/312, 306, 308, 611, 40/661, 642, 591, 593; 221/279, 213, 155, 244; 428/155, 167

[56] References Cited

U.S. PATENT DOCUMENTS

| | | | |
|---|---|---|---|
| 3,174,608 | 3/1965 | Knickerbocker | 221/155 |
| 4,718,532 | 1/1988 | Chalabian | 221/155 |
| 4,794,712 | 1/1989 | Wood | 40/124.1 X |
| 4,998,985 | 3/1991 | Sankey | 40/312 |
| 5,011,446 | 4/1991 | Feinberg | 40/661 X |

*Primary Examiner*—Kenneth J. Dorner
*Assistant Examiner*—Cassandra Davis
*Attorney, Agent, or Firm*—Frank H. Foster

[57] ABSTRACT

A display placard and method of installation of the same display placard within a conventional newspaper rack with three clear viewing sides. The placard has three panels, two outer, equally sized panels and a central, slightly wider panel. The two outer panels are hingedly connected to the central panel and can hinge about the central panel by approximately 360°. The placard is either folded along its hinged connections, or rolled into a tube and then bent and inserted into the newspaper rack. The placard is flexible enough to be rolled into a tube, and is resilient enough to regain its generally flat, sheet-like shape after being rolled into a tube and bent into the newspaper rack.

The insertion of the placard into the newspaper rack includes overlapping the panels of the placard, inserting the placard into the rear of the newspaper rack and opening the overlapped panels. The panels of the placard are then aligned parallel to a corresponding side wall of the newspaper rack.

15 Claims, 4 Drawing Sheets

CHANGEABLE DISPLAY NEWSPAPER VENDING MACHINE

TECHNICAL FIELD

This invention is related to newspaper dispensing racks and more particularly to such dispensers having transparent viewing sidewalls.

BACKGROUND ART

Modern newspaper racks are conventionally made of an aluminum frame, a transparent, three-sided, polycarbonate shell, reinforced aluminum top, steel door and armor head for holding coins and a coin-operated, mechanical device.

The polycarbonate shell is used because it has high toughness and strength and good formability. Its transparency permits the newspaper distributor to see the remaining supply of papers to determine whether the supply should be supplemented. The polycarbonate shell is usually painted at the rack factory with the newspaper's name and colors on its interior sides. The painted surfaces are viewed from the exterior of the rack through the polycarbonate shell.

If a newspaper company decides to change the paint scheme of its racks, the polycarbonate shell must be removed and either the paint stripped off and the shell repainted, or a new shell purchased and painted. In either case, a significant cost is incurred and significant time is spent repainting or replacing the shell. The end result of changing the paint scheme is high cost, money not earned and newspapers not dispensed.

Due to the high cost associated with changing the painting schemes on the shells of racks, newspaper companies are discouraged from changing their promotions, advertisements, and colors. It is desirable to change these in order to follow changing campaigns and changes in surrounding colors.

Newspaper racks must exist in harsh conditions due to human abuse, weather, and a corrosive environment, and a display must be protected from these elements so as to remain appealing to the viewer. The polycarbonate shells used in newspaper racks usually have a pair of holes in the back of the rack, near the top, through which a chain or cable is fed and fastened to a sturdy object to prevent theft. Rain and snow can easily pass through these holes, usually contacting the interior surface of the shell. Additionally, salty air near saltwater can also pass through not only the holes, but also any small crevices where dissimilar materials of which the rack is formed join, allowing an extremely corrosive environment to exist within the rack. Any display must survive all of these conditions and maintain its appearance in order to be considered suitable for a newspaper rack.

Gifford, in U.S. Pat. No. 1,452,873, discloses a garbage container having display cards inserted into opposing slots formed on the exterior of the container. Not only are the display cards located on the exterior of the machine where they can easily be removed by vandals, but they are each a single flat panel, each held in place by its own pair of opposing slots which would not be adaptable to use in a conventional newspaper rack without extensive modification to the rack. Additionally, the display cards are not described as having any weather resistance, making their placement on the exterior of the container unsuited to typical newspaper rack locations.

Williams, in U.S. Pat. No. 4,940,160, describes a display apparatus for attachment on the interior of a door of a newspaper machine. The display apparatus is for use within a newspaper machine, but has the disadvantage of requiring a person to purchase a newspaper in order for the person to view the display. Additionally, the display apparatus is substantially smaller than the displays conventionally painted on the interior surface of the newspaper racks.

Kay, in U.S. Pat. No. 3,793,756, discloses a garbage container having four doors, each of which opens outwardly of the container and has an interior display door into which a poster or other display item is inserted. While the garbage container is for use in the outdoor environment, and as such is described as weatherproof, the use of four separate doors to form a multi-sided display makes the display apparatus particularly unadaptable for a conventional newspaper rack, due to the construction of conventional newspaper racks.

There is a need for a means and method of exhibiting a display from a newspaper rack that is more easily, quickly and less expensively changed and which is readily able to be used in conventional racks without modification.

BRIEF DISCLOSURE OF INVENTION

The invention contemplates a flexible, resilient, water-resistant display placard which comprises three panels which are hingedly connected at adjoining edges. The placard can be removably inserted into a newspaper rack that has three transparent sidewalls.

The invention also contemplates a method of inserting such a placard into a newspaper rack having three transparent sidewalls, a top end, a bottom end and a fourth sidewall having an opening. The method of insertion comprises overlapping the panels of the placard and inserting one end of the placard into the opening of the fourth sidewall. After inserting a first end into the rack, that end is guided toward the bottom of the rack and a second end of the placard is guided toward the to end of the rack. The placard is opened and each panel of the placard is aligned substantially parallel to a sidewall of the rack.

Figure 1:
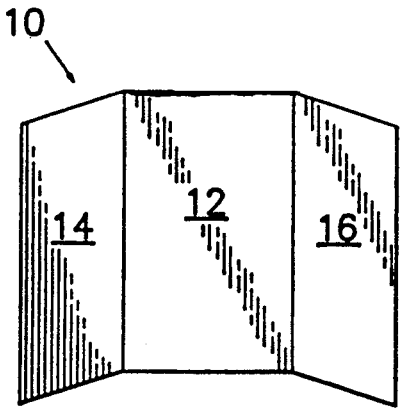
FIG. 1 is a view in perspective illustrating the preferred placard.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the present invention is a placard 10 made up of a center panel 12 and two outer panels 14 and 16, illustrated in FIG. I. The center panel 12 is hingedly connected to each outer panel 14 and 16, the outer panels 14 and 16 connecting to opposite edges of the center panel 12. The hinged connection between the panels is preferably a "live" hinge, i.e. one which permits pivoting of a panel 360° with respect to the adjoining panel. The entire placard 10, in the preferred embodiment, is approximately 30 inches tall and 45 inches wide. The two outer panels 14 and 16 are preferably equal in size to each other, and the center panel 12 is preferably slightly wider, but of equal height to the outer panels 14 and 16. The sizes are selected to allow the placard to fit within the newspaper rack and preferably to extend over the entire area of each transparent polycarbonate wall.

The placard 10 is preferably made from white, 35 mil thick polyethylene sheet, slit part way through its thickness from both sides to form a "hinge" which separates each outer panel 14 and 16 from the center panel 12. The panels actually hinge with respect to each other due to the flexure of a large number of parallel, evenly spaced fibers which are embedded mid-thickness ,8 through the polyethylene sheet. These fibers are exposed when the sheet is slit partially through from either side and the fibers are all that mechanically connects the panels. The hinged connections allow the outer panels 14 and 16 to pivot with respect to the center panel 12, and the "hinges" define the transition from one panel to the next. The hinges are preferably continuous along the height of the panels and can be flexed back and forth many times without breaking. Preferably, the hinged connections have a pleasing appearance on both sides of the placard 10.

It would be within the scope of the invention to use another hinging connection between the panels. For example, by crimping a sheet at the "hinges" to form a localized thin band at which flexure is preferred, the equivalent hinged panels are formed. Additionally, a piano hinge or a pair of conventional cabinet hinges could also be riveted to flexible panels to achieve an acceptable placard.

The panels 12, 14 and 16 of the placard 10 are flexible enough to allow it to be rolled up, bent and inserted through a door opening in a newspaper rack without breaking the placard 10. The panels of the placard 10 also preferably have enough resilience to return to their preferred flat shape after being flexed and inserted into a newspaper rack. It is also preferred that any printing or coloration applied to the placard 10 maintain its original appearance, even after scratching or scraping the placard 10, which occurs during normal use. Additionally, the preferred placard 10 has printed matter on both sides, allowing it to merely be removed, and turned around, and replaced, in its display position in order to display its second side.

Figure 2:
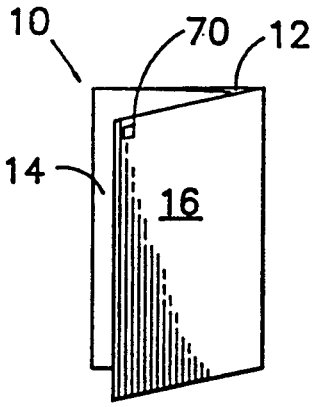
FIG. 2 is a view in perspective illustrating a folded preferred placard.
Figure 3:
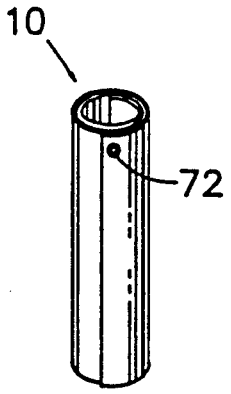
FIG. 3 is a view in perspective illustrating a rolled preferred placard.

FIG. 2 shows the placard 10 of FIG. 1 with the outer two panels 14 and 16 folded over the center panel 12. FIG. 3 shows the placard 10 of FIG. 1 rolled up in a "tube" shape.

Figure 4:
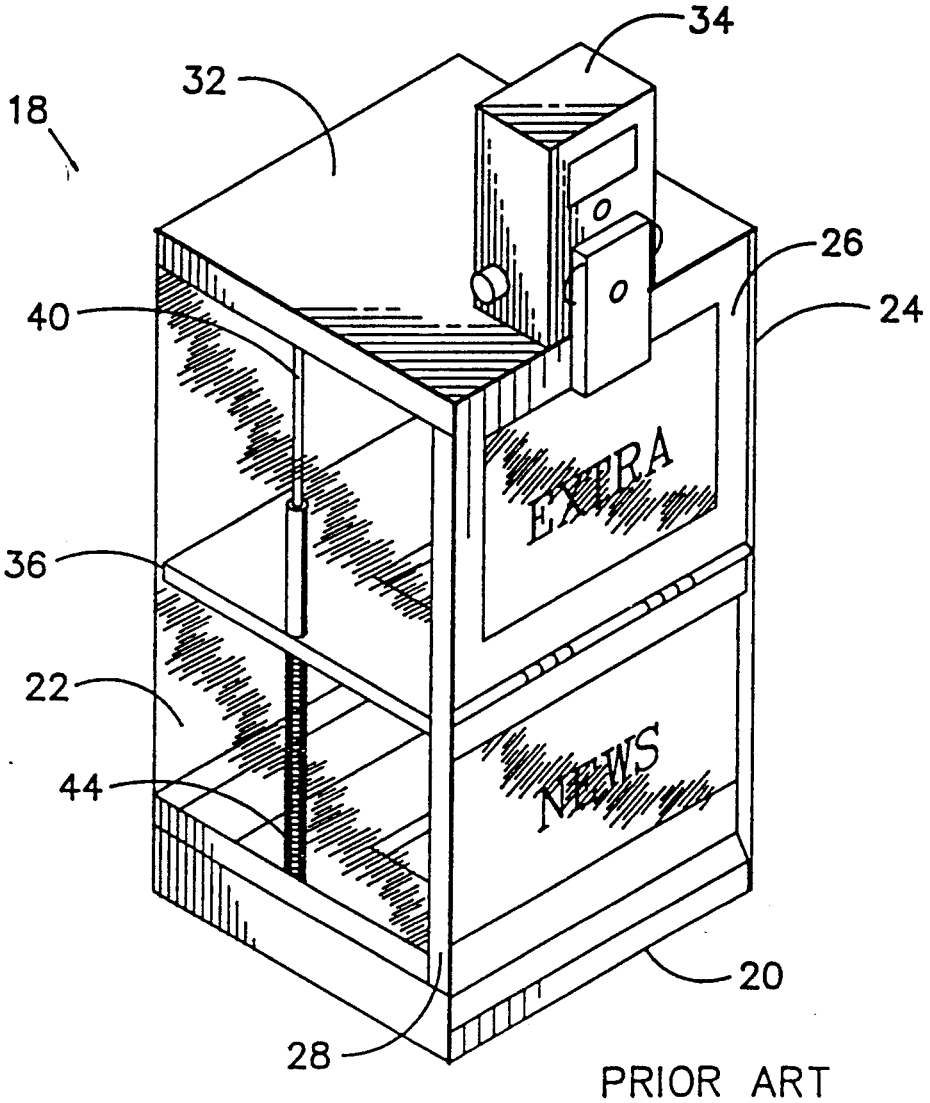
PRIOR ART FIG 4
FIG. 4 is a front view in perspective illustrating a conventional newspaper rack.
Figure 5:
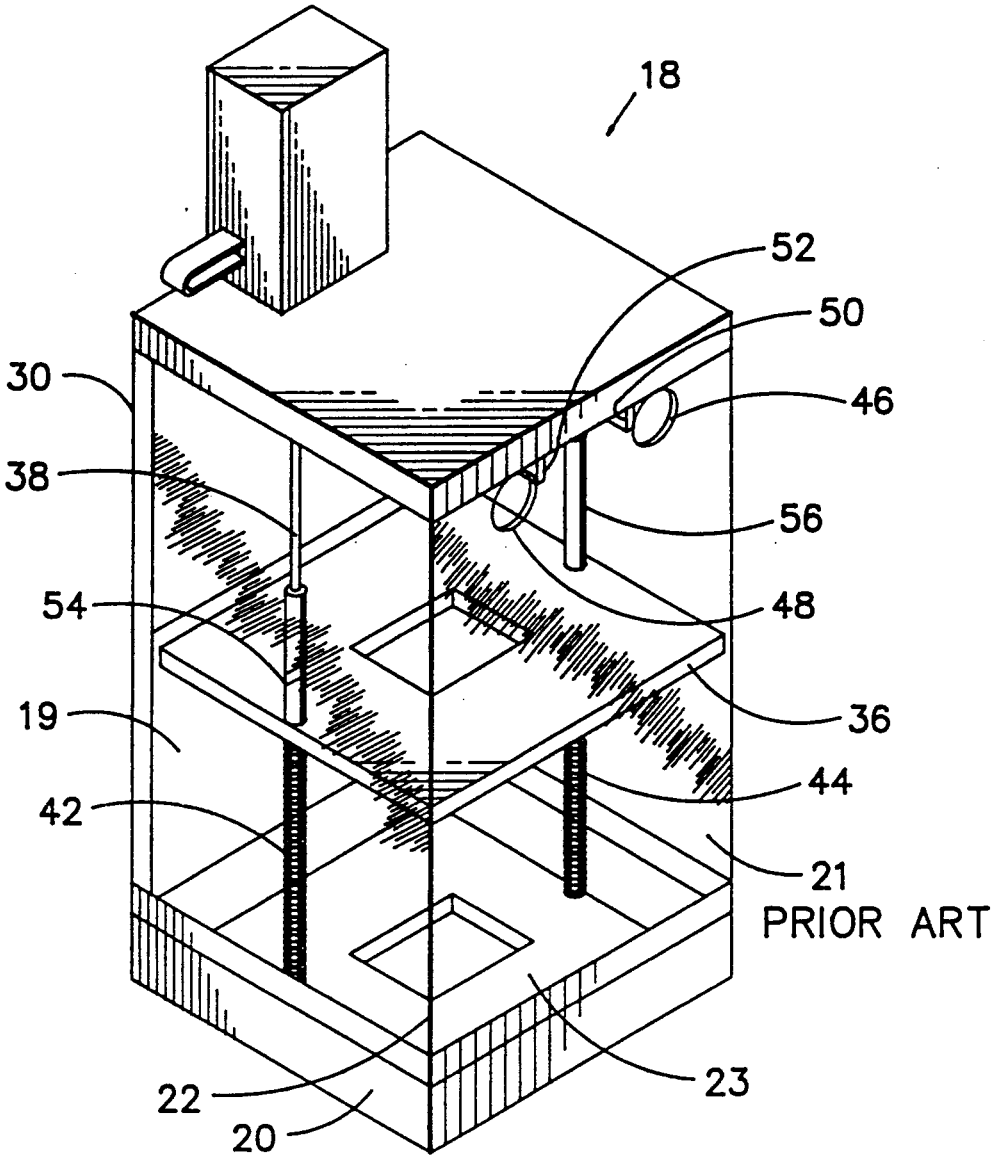
FIG. 5 is a rear view in perspective illustrating a conventional newspaper rack.

FIGS. 4 and 5 show a conventional newspaper rack 18 with which it is preferred the present invention be used. The newspaper rack 18 has a base 20 which is made of aluminum or steel. Directly connected to the base 20 is a wall unit 22, consisting of two sidewalls 19 and 21 connected at 90° angles with respect to a rear sidewall 23. A front sidewall 24, having a door 26, also attaches to the base 20 and attaches at its sides to side posts 28 and 30. A top 32, having an armored head 34, is placed on top of the wall unit 22 and the front sidewall 24, attaching to those and the side posts 28 and 30. The top 32 has approximately the same dimensions as the base 20.

The wall unit 22 is made from a transparent polycarbonate sheet that is bent along two lines forming corners and angling the two bent regions at 90 angles to a centrally located region. Each region then forms a sidewall, and the entire wall unit 22 is shaped like a "U" when viewed from the top or the bottom of the newspaper rack 18.

An elevator shelf 36 is vertically movable within the newspaper rack 18 along a pair of rods 38 and 40. The elevator shelf 36 is upwardly biased by a pair of springs 42 and 44 which encircle the rods 38 and 40. The rear sidewall 23 has two holes 46 and 48 extending through it near the top. A pair of long, flat support members 50 and 52, which are attached at one of their edges to the top 32, extend longitudinally from the front to the back of the newspaper rack 18. The support members 50 and 52 terminate at the rear of the newspaper rack 18 near the holes 46 and 48, forming a gap between the ends of the support members 50 and 52 and the rear sidewall 23.

The two rods 38 and 40 extend from a pair of holes formed in the base 20 of the newspaper rack 18, through the elevator shelf 36 and into a second pair of mounting holes formed through two brackets that are attached to the interior of the top 32. The rods 38 and 40 each have a narrow, radially directed hole formed through them, through which a metal pin is inserted once the rods 38 and 40 are in position in the newspaper rack 18. Coil springs 42 and 44 are aligned generally coaxially with the rods 38 and 40. The coil springs 42 and 44 contact the base 20 at one end and extend into and contact the top ends of a pair of tubes 54 and 56 at their opposite ends. The tubes 54 and 56 are rigidly mounted to the elevator shelf 36. The weight of the shelf 36 and any newspapers on the shelf 36 compresses the springs 42 and 44.

The newspaper rack 18 is of the type which is conventionally manufactured and sold. The structures of the elevator shelf mechanisms vary by manufacturer, but they are all similar in appearance and function.

The placard 10 is installed and removed from the newspaper rack 18 through the door 26 in the front sidewall 24. The placard 10 is preferably both installed and removed using the same method, merely by reversing the order of the steps taken.

Using the preferred method of placard installation, the pins are removed from the tops of the rods 38 and 40 after opening the door 26 of the newspaper rack 18 of FIGS. 4 and 5. The newspaper rack 18 is next tilted onto its rear sidewall 23 with the front sidewall 24 facing upwardly. The rods 38 and 40 are then slid out through the holes in the base 20 and either removed completely or at least pulled most of the way out of the interior of the newspaper rack 18. The springs 42 and 44 and the elevator shelf 36 are then removed from the interior of the newspaper rack 18.

Figure 6:
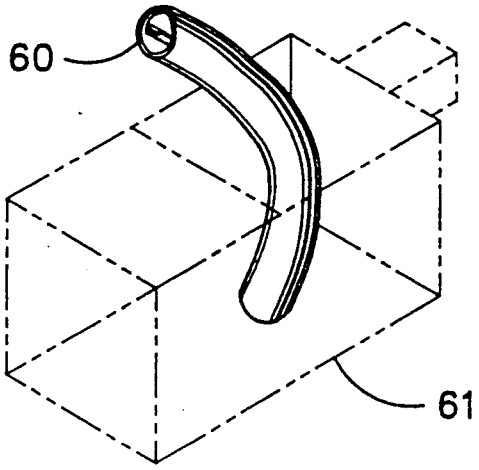
FIGS. 6, 7 and 8 are views in perspective illustrating a preferred series of steps of a placard being inserted into a conventional newspaper rack.

FIG. 6 illustrates a rack 61, such as the one shown in FIGS. 4 and 5, in phantom and without a door, but having an opening simulating an open door. A placard 60 is shown in FIG. 6 rolled into a tube of approximately 6 to 8 inches in diameter, similar to the placard 10 shown in FIG. 3. This tube shape is constructed by grasping one of the outer edges of an outer panel 14 or 16 of the placard 10, shown in FIG. 1, and folding the panel over itself with a small radius, overlapping the back surface of one panel over the front surface of another. This process is continued all the way across the width of the placard 10, forming a "tube", as shown in FIGS. 3 and 6.

Figure 7:
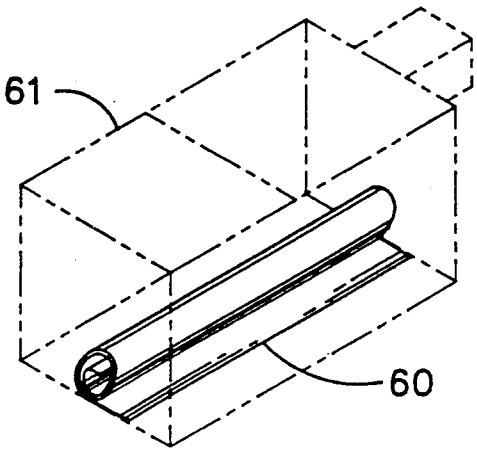

The placard 60 of FIG. 6 is inserted through the door opening, bottom end first, by bending it along its axis, while directing the bottom end toward the base of the newspaper rack 61. When the bottom end of the placard 60 is near the base of the newspaper rack 61, the top end of the placard 60 is inserted through the door opening and is guided toward the top of the rack 61, after which, the placard 60 is placed against the rear wall as shown in FIG. 7.

Figure 8:
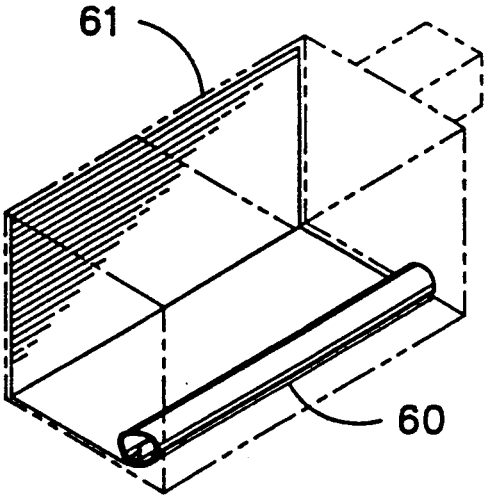

An edge of the placard 60 that is parallel to the axis of the "tube" is pulled laterally away from the "tube", unrolling it. Support members 50 and 52, shown in FIG. 5, form a gap between their rearmost ends and the rear wall 23, as described above. The top edge of the unrolled panel is placed in the gap formed between the rear wall and the support members. While the placard 60 is being unrolled, it is fed through the support member's gaps until the outermost edge of a first panel, that is the farthest edge from the "tube", reaches the side post of the rack 61. This is illustrated in FIG. 8. After this, the remainder of the placard 60 is unrolled and is placed against the inner surfaces of the sidewalls. The whole placard 60 is then pressed against the inner surfaces of the sidewalls in order to align each panel of the placard 60 generally parallel to the sidewalls of the rack 61.

In the preferred embodiment, an element of a means for removably fastening the placard 10 to the interior of the newspaper rack is attached both to the outermost top corners of the two outer panels 14 and 16 and to corresponding locations on the interior sidewalls of the newspaper rack 18. An example of a fastening means would be a material having hooks or loops on one side and adhesive backing on the opposite, such as is sold under the trademark "Velcro". One element 70 of a "hooks and loops" fastening means is shown on the panel 16 in FIG. 2. Another example is a snap 72, an element of which is riveted to the placard 10 shown in FIG. 3. The fastening means is used to hold the outer panels 14 and 16 from sagging or drooping down under their weight. The fastening means are not visible from outside the newspaper rack 18 when the placard 10 is in place, as they are hidden behind the side posts 28 and 30. In addition to the fastening means 70 and 72, illustrated in FIGS. 2 and 3, the center panel 12 is supported within the gap formed between the support members 50 and 52 and the rear wall 23 of the newspaper rack 18, shown in FIGS. 4 and 5. While the fastening means and support within gaps are not necessary to the operation and functioning of the present invention due to the preferred ability of the placard 10 to stand up in place on its own, they are preferred since the fastening means secure the placard 10 in place beyond what is necessary to be certain it stays standing.

Figure 9:
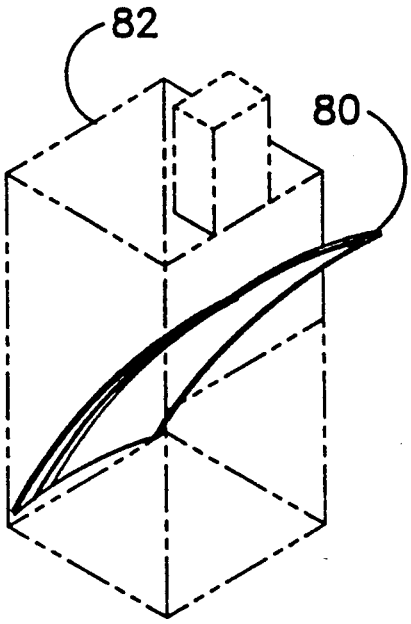
FIGS. 9, 10 and 11 are views in perspective illustrating an alternative series of steps of a placard being inserted into a conventional newspaper rack.
Figure 10:
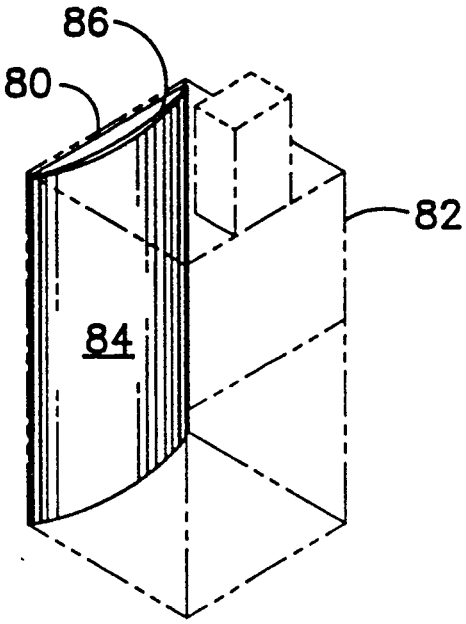
Figure 11:
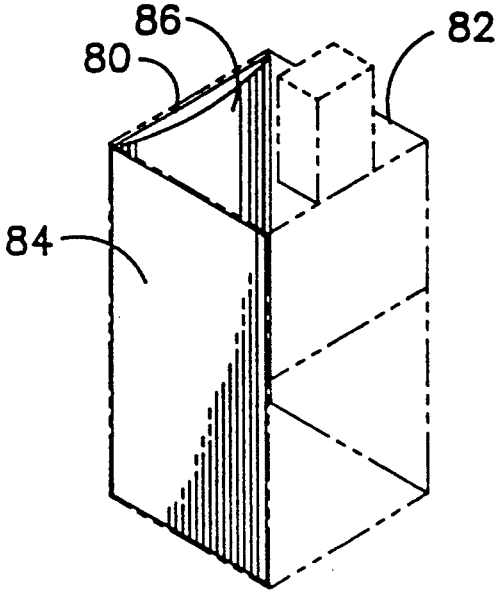

FIG. 9 shows a placard 80 that is folded like the placard 10 shown in FIG. 2, and then partially inserted into a newspaper rack 82 after an elevator shelf, rods and springs have been removed as in the preferred method. FIG. 9 shows the newspaper rack 82 standing upright, which is an alternative to laying the newspaper rack 82 on its rear wall. The placard 80 is folded, like the placard 10 in FIG. 2, and then bent and inserted, bottom first, into the rack 82. The top edge of the placard 80 is inserted into a gap between a pair of ends of a pair of support members extending from the top of the rack 82, and the rear sidewall at the time it is pressed against the rear sidewall as shown in FIG. 10. Side panels 84 and 86 are bent about their hinged connections with the adjoining panel, outward toward the sidewalls of the newspaper rack 82, which is illustrated in FIG. 11. After opening the placard 80, all the panels of the placard 80 are pressed against the sidewalls of the newspaper rack 82, in order to orient them parallel to the sidewalls, and a fastening means is engaged, if the newspaper rack 82 and placard 80 are so equipped.

If it is desired that the shelf 36, as shown in FIGS. 4 and 5, remain in the newspaper rack 18, the present invention can still be used. The installer needs to only loosen and tilt the shelf forward by removing the pins holding the rods 38 and 40 from connection with the top 32. By tilting the shelf 36 forward, a gap about three inches wide is formed between the back of the shelf 86 and the rear sidewall.

Figure 12:
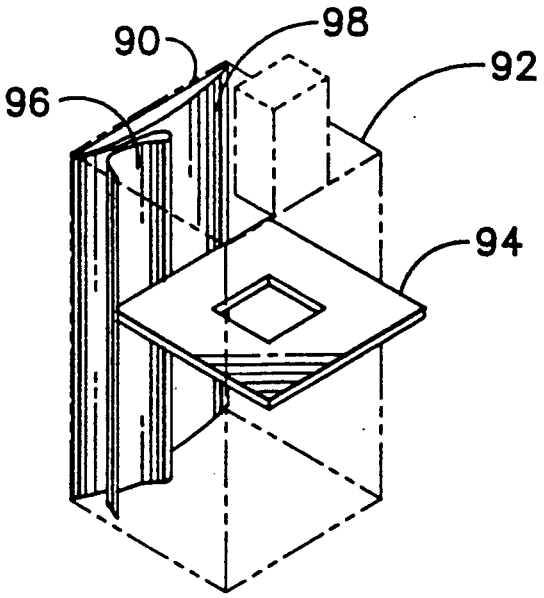
FIG. 12 is a view in perspective illustrating a placard being inserted into a conventional newspaper rack having a shelf in place.

A placard 90 may be inserted into a rack 92 behind a shelf 94 that is still in a rack 92, as illustrated in FIG. 12. This is done by first inserting the folded placard 90 into the rack 92 in a manner similar to that shown in FIGS. 9 and 10 only behind the shelf 94 which has been loosened and pulled toward the door opening of the rack 92, as shown in FIG. 12.

Once the placard 90 is to be opened, a new method must be used. One panel 96 of the placard 90 is bent over itself and curled around the rear edge of the shelf 94 in the gap formed between the rear edge of the shelf 94 and the rear sidewall. The free edge of the panel 96 is then pulled toward the door opening in the rack 92, pulling the panel 96 between a side edge of the shelf 94 and the sidewall, aligning the panel 96 parallel to the sidewall of the rack 92 once the panel 96 has extended completely beside the shelf 94. A second panel 98 is opened by an identical process, the panels are pressed against the sidewalls of the rack 92, after which the shelf 94 is reconnected and a fastening means is engaged if the rack 92 and placard 90 are so equipped.

Figure 13:
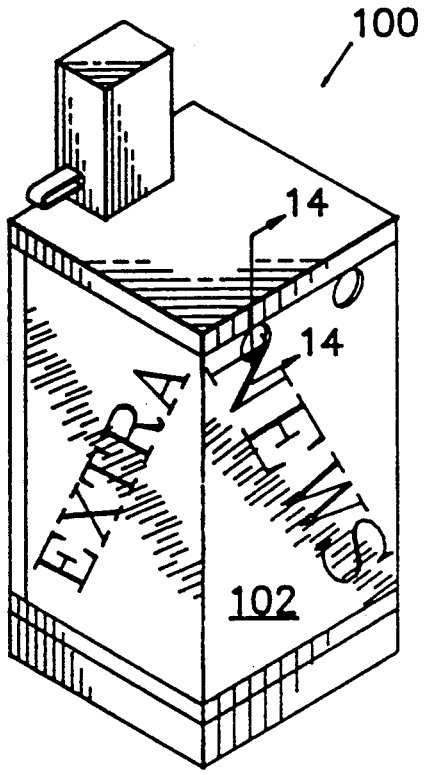
FIG. 13 is a view in perspective illustrating a conventional newspaper rack.

FIG. 13 shows a newspaper rack 100, having a placard 102 inserted within the newspaper rack 100 in the preferred position. This is the end result of the described methods of insertion of a placard into a newspaper rack. The printing on the placard 102 is viewed through the transparent sidewalls of the newspaper rack 100, as illustrated in FIG. 13.

Figure 14:
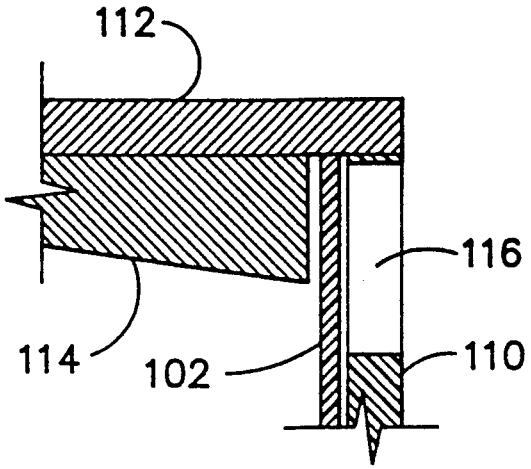
FIG. 14 is a side view in section illustrating the newspaper rack of FIG. 3 along the line 14—14.

A view in section of a portion of FIG. 13, along the lines 14—14, is illustrated in FIG. 14. In FIG. 14, a rear sidewall 110 attaches at its top to a newspaper rack top 112. A support member 114 attaches at one edge to the top 112 and extends along the top 112 to near the rear sidewall 110, forming a gap between the end of the support member 114 and the inner edge of the rear sidewall 110. The gap is formed near a hole 116, formed in the rear sidewall 110. The placard 102 slides into the gap and is supported within the gap in the preferred embodiment. The support of the placard 102 in the gap between the support member 114 and the rear sidewall 110 is explained above and is illustrated in FIG. 14 to emphasize the physical structure.

In the newspaper rack 18, shown in FIGS. 4 and 5, holes 46 and 48 are formed through the rear wall 23, through which a chain or cable may be passed in order to lock the newspaper rack 18 to a sturdy object. An alternative placard may have holes formed through it corresponding to the holes 46 and 48 in order to allow a chain or cable to be used, without a panel of the placard hindering installation.

Figure 15:
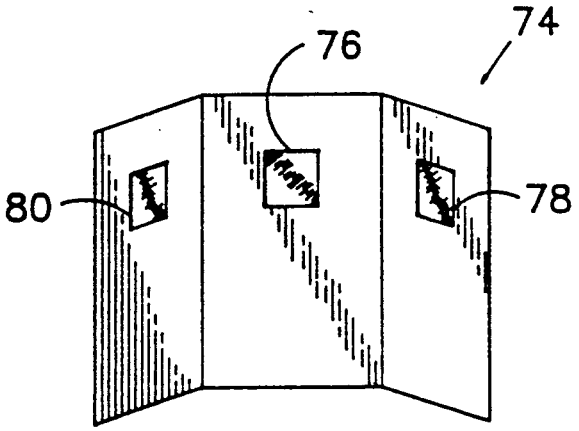
FIG. 15 is a view in perspective illustrating an alternative placard.

FIG. 15 illustrates an alternative placard 74 having viewing regions 76, 78 and 80 formed in each panel of the placard 74. These viewing regions are to allow someone to view the contents of the newspaper rack in which the placard 74 is inserted. These viewing regions 76, 78 and 80 may be either areas of the placard 74 which are transparent, or may equivalently be holes cut in the placard 74.

A placard used in the present invention, and inserted by any of the present methods, is preferably flexible and resilient, as previously discussed. The flexibility is necessary due to the bending and curling of the panel in certain methods of installation and preferably includes flexibility even at extreme temperatures. Additionally, the resilience, as discussed previously, is necessary in order that each panel of the placard retain its original, generally planar shape, even after being bent. The placard is also preferably water resistant, meaning the placard and the printing on it are effectively unaffected by water. The placard needs to be water resistant because of the weather conditions to which it is exposed. If the placard is not water resistant, it may become water soaked, stained or it may collapse and pull away from the sides or otherwise become unattractive due to the weight or destructive characteristics of the water.

While certain preferred embodiments of the present invention have been disclosed in detail, it is to be understood that various modifications may be adopted without departing from the spirit of the invention or scope of the following claims.

I claim:

1. An improved newspaper display rack comprising:

a housing three transparent sidewalls;

a fourth sidewall having an opening and a door mounted in the opening for access to the interior of the housing; and a display placard having three generally planar panels, hingedly connected at adjoining edges and removably supported in the newspaper rack against the three transparent sidewalls, the display placard being sufficiently flexible to permit it to be bent and inserted into the newspaper rack in the absence of creases and breakage of the placard, being sufficiently resilient to return the panels to generally planar and being sufficiently water resistant to avoid significant deterioration from moisture.

2. A newspaper rack display in accordance with claim 1 wherein the display placard is made of polyethylene sheet.

3. A newspaper rack display in accordance with claim 2 wherein one panel of the placard is centrally located between two outer panels and wherein a first element of a fastening means is attached to an outer top corner of each of the outer two panels of the placard and a second element of the fastening means is attached to a corresponding location on an interior of the rack sidewalls, for removably fastening the placard to the rack sidewalls.

4. A newspaper rack display in accordance with claim 3 wherein a first element of the fastening means is a material, having small, outwardly extending hooks and a second element of the fastening means is a material having small, outwardly extending loops.

5. A newspaper rack display in accordance with claim 1 wherein the placard has printed matter on both sides of all three panels.

6. A newspaper rack display in accordance with claim 1 wherein at least one region of the placard is transparent for viewing the contents of the newspaper rack.

7. A newspaper rack display in accordance with claim 1 wherein the height and width of each of the three panels of the placard are substantially equal to the height and width of each corresponding sidewall of the rack.

8. A newspaper rack display in accordance with claim 1 wherein the display rack further comprises a pair of support members, each member having an end near one sidewall, forming a pair of gaps between the ends of the members and the sidewall for inserting a panel of the placard into the gaps and supporting the panel by the members on one side of the panel and the sidewall of the rack on the opposite side.

9. A method of inserting a flexible, resilient display placard, having three hingedly joined panels, into a newspaper rack, the rack having three transparent sidewalls, a top end, a bottom end and a fourth sidewall having an opening, the method comprising:

(a) overlapping the panels of the placard;

(b) inserting a first, bottom end of the placard into the opening of the fourth sidewall;

(c) guiding the first end of the placard toward the bottom end of the rack;

(d) guiding a second, top end of the placard toward the top end of the rack;

(e) opening the placard; and (f) aligning each of the panels of the placard substantially parallel to a sidewall of the rack.

10. A method in accordance with claim 9 wherein overlapping the panels of the placard comprises rolling the placard into a tube, and wherein opening the placard comprises unrolling the tube-shaped placard.

11. A method in accordance with claim 9 wherein overlapping the panels of the placard comprises folding the panels along the hinged connection joining them, overlapping two of the panels onto the third, and wherein opening the placard comprises unfolding the two overlapping panels along the hinged connection joining them.

12. A method in accordance with claim 11 wherein the method further comprises temporarily removing an elevator shelf from the newspaper rack.

13. A method in accordance with claim 11 wherein the method further comprises loosening an attachment of an elevator shelf, tilting the shelf toward the opening in the fourth sidewall, and wherein opening the placard comprises winding and curling an edge that is not hingedly connected to another edge of the overlapping panels between the sidewalls and the elevator shelf to align and the panels with the sidewalls.

14. A method in accordance with claim 9 wherein the method further comprises removably fastening the outer top corners of two outer panels to a corresponding location on the interior of two of the sidewalls.

15. A method in accordance with claim 9 wherein opening the placard comprises sliding the top of at least one panel of the placard into a gap formed between a sidewall and a pair of downwardly extending support members.

* * * * *